US009508502B2

(12) United States Patent
Dromph et al.

(10) Patent No.: US 9,508,502 B2
(45) Date of Patent: Nov. 29, 2016

(54) PUSH BUTTON SWITCH HAVING A CURVED DEFORMABLE CONTACT ELEMENT

(71) Applicant: MEC A/S, Ballerup (DK)

(72) Inventors: Flemming Dromph, Taastrup (DK); Dan Larsen, Solrød Strand (DK)

(73) Assignee: MEC A/S, Ballerup (DK)

( * ) Notice: Subject to any disclaimer, the term of this patent is extended or adjusted under 35 U.S.C. 154(b) by 0 days.

(21) Appl. No.: 14/409,693

(22) PCT Filed: Jul. 18, 2013

(86) PCT No.: PCT/DK2013/050243
§ 371 (c)(1),
(2) Date: Dec. 19, 2014

(87) PCT Pub. No.: WO2014/012557
PCT Pub. Date: Jan. 23, 2014

(65) Prior Publication Data

US 2015/0194278 A1 Jul. 9, 2015

(30) Foreign Application Priority Data

Jul. 18, 2012 (EP) ..... 12176987

(51) Int. Cl.
*H01H 13/14* (2006.01)
*H01H 13/48* (2006.01)
(Continued)

(52) U.S. Cl.
CPC ..... *H01H 13/14* (2013.01); *H01H 13/48* (2013.01); *H01H 13/64* (2013.01); *H01H 13/78* (2013.01);
(Continued)

(58) Field of Classification Search
CPC ..... H01H 1/12; H01H 13/14
USPC ..... 200/512, 513, 5 A
See application file for complete search history.

(56) References Cited

U.S. PATENT DOCUMENTS 3,995,126 A * 11/1976 Larson ..... H01H 13/702 200/306
4,158,120 A 6/1979 Pawlowski
(Continued)

FOREIGN PATENT DOCUMENTS

CN 102543534 A 7/2012
EP 2 282 492 A1 2/2011
(Continued)

OTHER PUBLICATIONS

International Search Report for PCT/DK2013/050243 dated Nov. 8, 2013.

*Primary Examiner* — Edwin A. Leon
*Assistant Examiner* — Iman Malakooti
(74) *Attorney, Agent, or Firm* — Knobbe Martens Olson & Bear LLP

(57) ABSTRACT

The present invention relates to a push button switch 5 comprising a curved deformable contact element 4. The push button switch 5 comprises at least one first terminal point 1, at least one second terminal point 2, and at least one third terminal point 3. The deformable contact element 4 is switched between a first and a second state. In the first state the deformable contact element 4 connects the at least one first terminal point 1 with the at least one second terminal point 2 whereas there is neither contact between the at least one third terminal point 3 and the at least one first terminal point 1 nor between the at least one third terminal point 3 and the at least one second terminal point 2. In the second state the deformable contact element 4 connects the at least one first terminal point with the at least one third terminal point 3, whereas there is neither contact between the at least one second terminal point 2 and the at least one first terminal point 1 nor between the at least one second terminal point 2 and the at 1 least one third terminal point 3. This implies that the push button switch 5 is designed to be both normally closed and normally open.

11 Claims, 6 Drawing Sheets

(51) Int. Cl.
*H01H 13/64* (2006.01)
*H01H 13/78* (2006.01)

(52) U.S. Cl.
CPC .. *H01H 2203/026* (2013.01); *H01H 2203/038* (2013.01); *H01H 2215/006* (2013.01); *H01H 2215/036* (2013.01); *H01H 2225/018* (2013.01)

(56) References Cited

U.S. PATENT DOCUMENTS 4,733,590 A 3/1988 Watanabe
4,771,139 A 9/1988 DeSmet
5,726,400 A * 3/1998 Masuda ..... H01H 13/64 200/1 R
6,636,164 B1 * 10/2003 Salminen ..... H01H 13/7006 200/345
6,936,777 B1 8/2005 Kawakubo
2005/0199475 A1 9/2005 Kawakubo
2011/0233037 A1 9/2011 Wilkolaski
2011/0297524 A1 12/2011 Low et al.

FOREIGN PATENT DOCUMENTS

FR 2 841 037 A1 12/2003
JP 2004-311128 A 11/2004

* cited by examiner

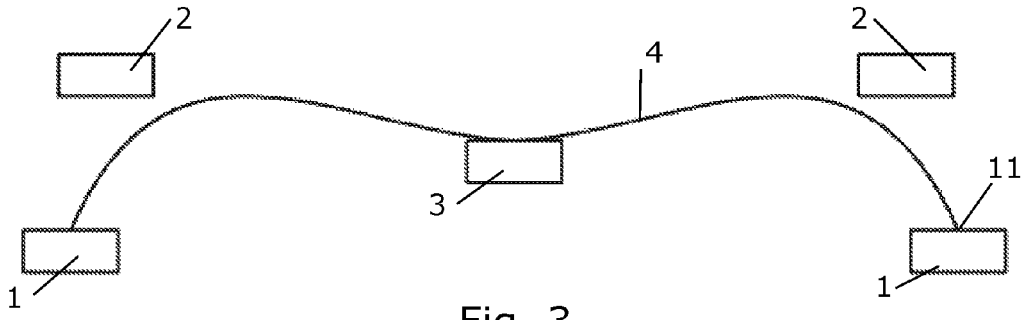
Fig. 3
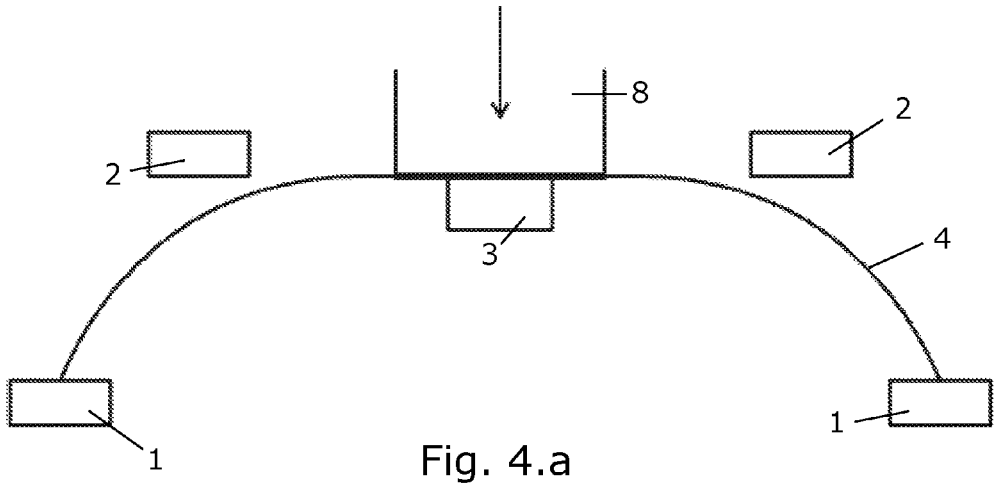
Fig. 4.a
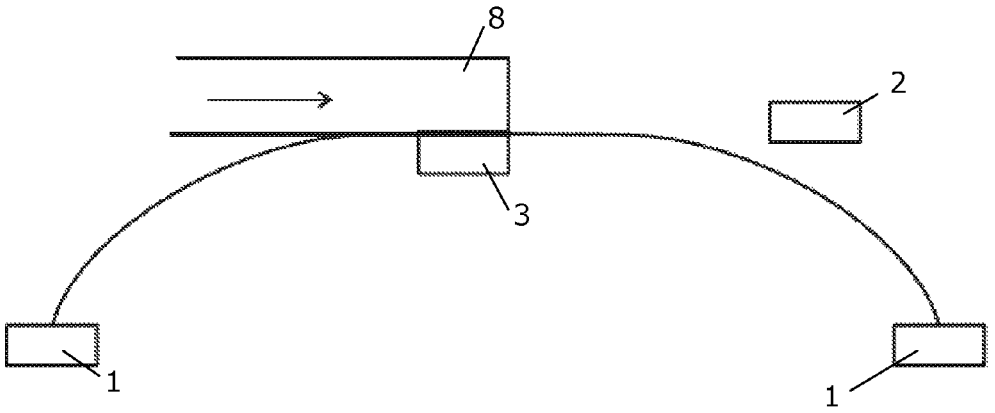
Fig. 4.b

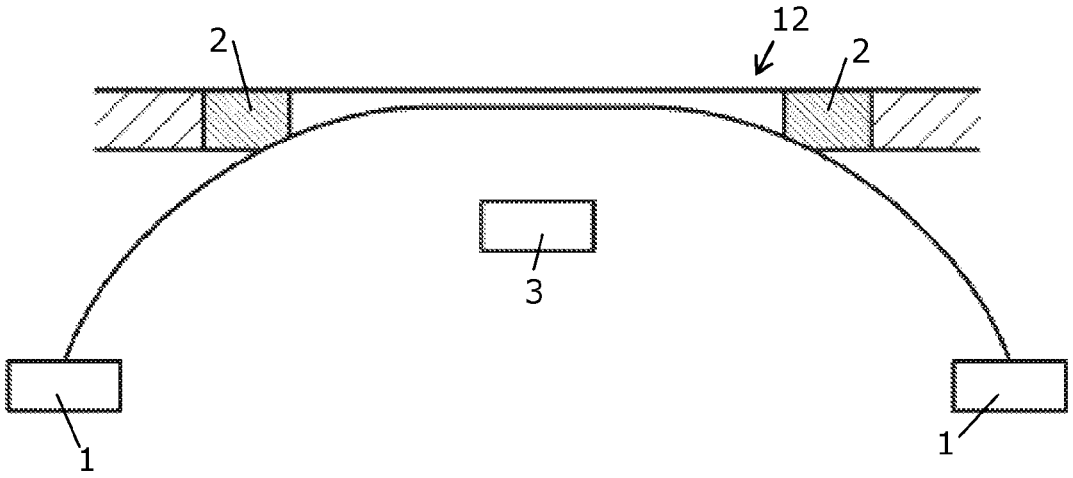
Fig. 8
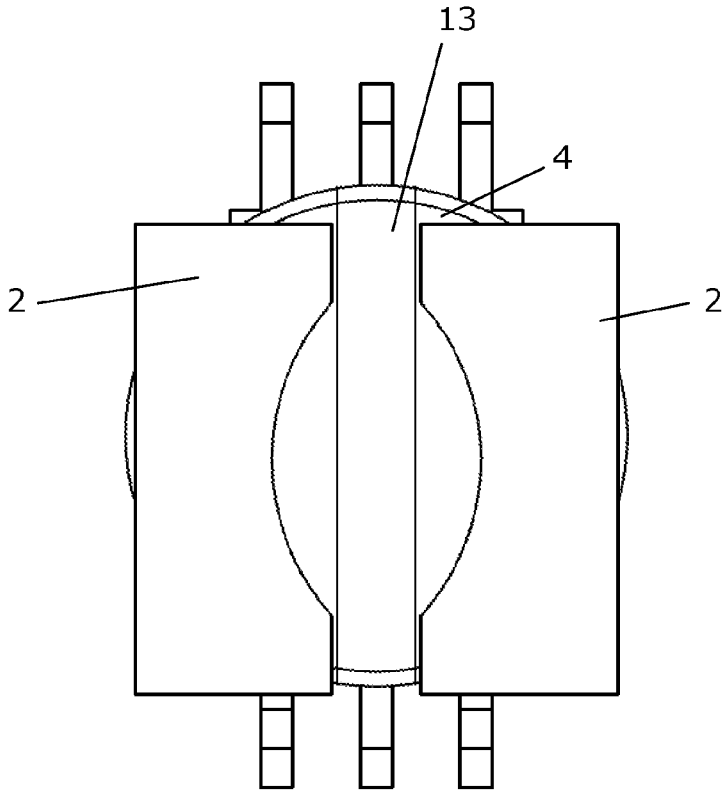
Fig. 9.a

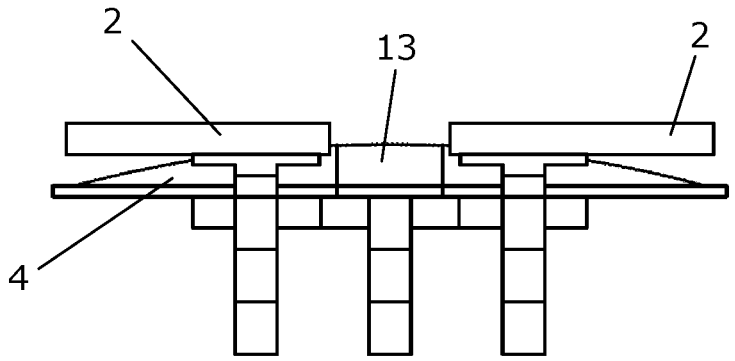
Fig. 9.b
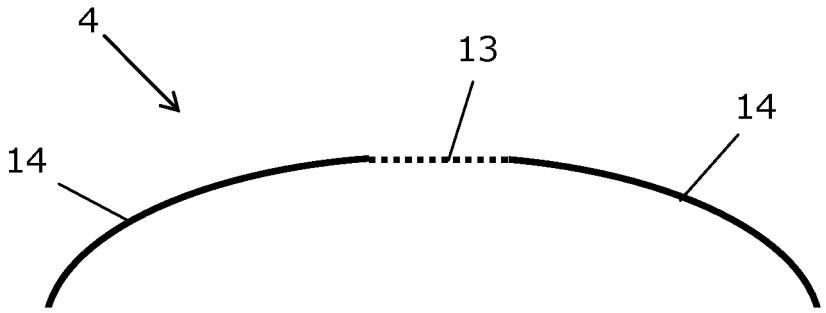
Fig. 10.a
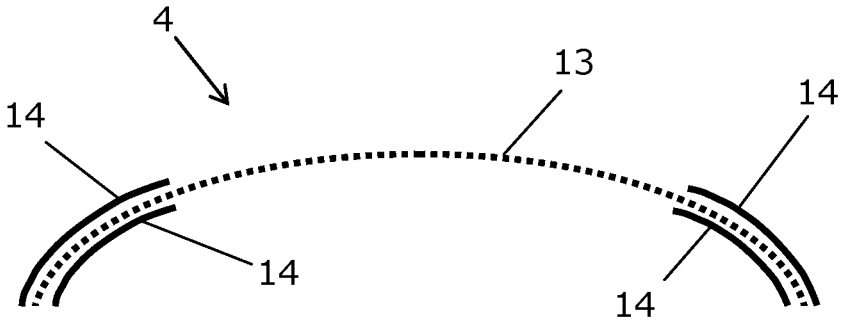
Fig. 10.b

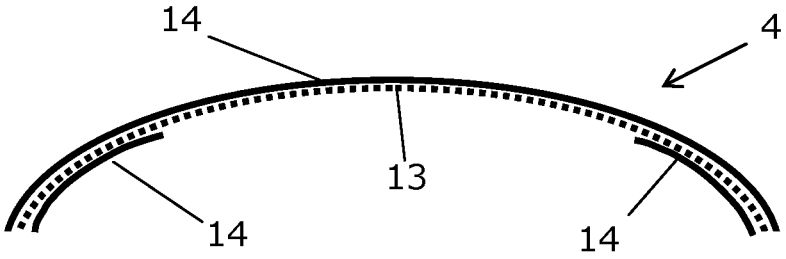
Fig. 10.c
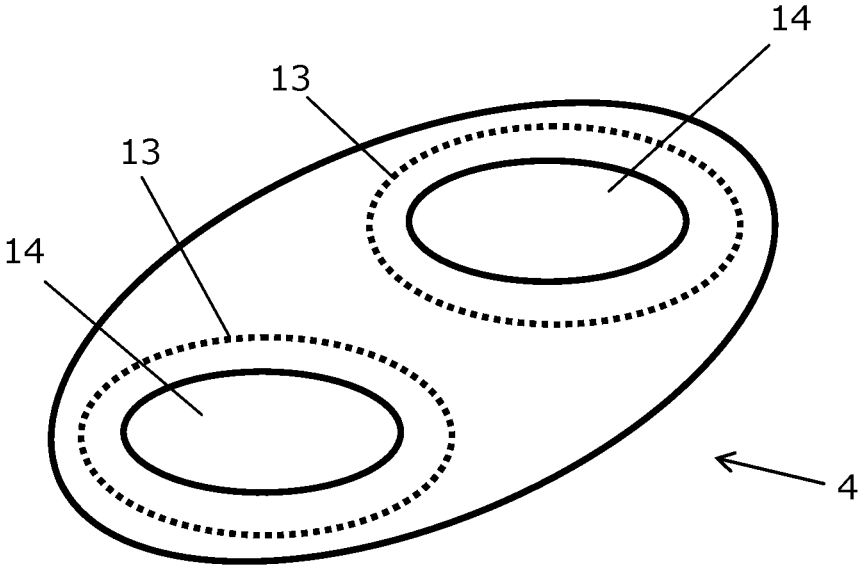
Fig. 11

PUSH BUTTON SWITCH HAVING A CURVED DEFORMABLE CONTACT ELEMENT

CROSS REFERENCE TO RELATED APPLICATIONS

This application is a U.S. National Phase Application of PCT International Application Number PCT/DK2013/050243, filed on Jul. 18, 2013, designating the United States of America and published in the English language, which is an International Application of and claims the benefit of priority to European Patent Application No. 12176987.1, filed on Jul. 18, 2012. The disclosures of the above-referenced applications are hereby expressly incorporated by reference in their entireties.

FIELD OF THE INVENTION

The present invention relates to push button switches having a curved deformable contact element, and in particular to such switches being both normally closed and normally open.

BACKGROUND OF THE INVENTION

Push button switches comprising curved deformable contact elements, such as dome-shaped contact elements, are used in a number of applications where it is desired to establish electrical connection between one set of terminal points to another set of terminal points by deformation of the deformable contact element. The terminal points may typically be arranged along the edge of the deformable contact element and centrally below the concave surface thereof so that contact is obtained by excering a pressure on the deformable contact element. Such a switch may e.g. be used in equipment that is to run only when a safety button is being constantly pressed, or in equipment where a signal is to be generated when a button is pressed. Such a signal may e.g. be an audio signal used to get attention, or it may be a signal adapted to trigger the start of another set of events.

For some applications, such as for safety buttons as described above, there is a risk of an erroneous continued registration of the button being pressed even after the user of the equipment has stopped pressing the button. As an option in such appliances, one could run a check on both of the outputs of a normally open normally closed switch to assess whether the button is pressed or not.

Hence, an improved push button switch would be advantageous, and in particular a more reliable push button switch would be advantageous.

OBJECT OF THE INVENTION

It is an object of the present invention to provide a push button switch being both normally open and normally closed.

It is another object of the present invention to provide a push button switch having a larger build-in safety than with presently known switches.

It is a further object of the present invention to provide an alternative to the prior art.

SUMMARY OF THE INVENTION

Thus, the above described object and several other objects are intended to be obtained in a first aspect of the invention by providing a push button switch, comprising a deformable contact element having a first convex surface and an opposite second concave surface, wherein:

- at least one first terminal point is disposed adjacent to an edge of and electrically connected to the deformable contact element,
- at least one second terminal point is disposed so that it is electrically connectable to the first surface of the deformable contact element at a distance from the edge of the deformable contact element, and
- at least one third terminal point is disposed so that it is electrically connectable to the second surface of the deformable contact element and is disposed in the volume defined by the second concave surface and at a distance from the edge of the deformable contact element, and wherein, when in use, the deformable contact element has:

- a first state in which the deformable contact element is unactivated and connects the at least one first terminal point with the at least one second terminal point, whereas there is neither contact between the at least one third terminal point and the at least one first terminal point nor between the at least one third terminal point and the at least one second terminal point, and
- a second state in which the deformable contact element is activated and connects the at least one first terminal point with the at least one third terminal point, whereas there is neither contact between the at least one second terminal point and the at least one first terminal point nor between the at least one second terminal point and the at least one third terminal point.

A switch having such a configuration is also referred to as being both normally closed and normally open, where "normally" refers to the switch being in an unactivated state; i.e. a state in which the contact element is in an undeformed state. With the grouping of the terminal points as mentioned above, the switch is normally closed with respect to connections between the at least one first terminal point and the at least one second terminal point and normally open with respect to connections between the at least one third terminal point and the at least one first terminal point and the at least one second terminal point. This may be more clear from the below description of the figures.

The terminal points are preferably fixed and are adapted to be connected to electrical circuits, such as to a printboard. The number of switches used for a given application may vary from one switch and up to any desired number. "Fixed" does not imply that no movement may take place. It will e.g. be possible to have at least some of the terminal points arranged on elastically deformable material which is slightly deformed when the switch is actuated.

The deformable contact element may be made from electrically conductive material throughout the thickness. Alternatively it may be made from an electrically isolating material, such as silicone or PE, which is covered by an electrically conducting material, such as a nickel or copper. Yet another alternative may be a deformable contact element made from a rubber material filled with electrically conducting particles. This means that the contact will be a mechanical and/or an electrical contact depending on the actual composition thereof.

In some embodiments of the invention, the first and the second surfaces of the deformable contact element have double curvature; i.e. surfaces which curve in two directions. It may e.g. be dome shaped, such as being hemi-spherical, or having different curvatures in two perpendicular directions. An advantage of a hemi-spherical shape is that there is no restriction with respect to orientation during mounting. On the other hand, a non-symmetrical shape may be desired to ensure a specific orientation of the deformable contact element, e.g. for embodiments where it comprises electrically isolating regions as will be described below.

The deformable contact element may alternatively have first and second surfaces which are linear in one direction and curved in the other directions. It may e.g. be in the form of a curved, such as bent, strip of electrically conducting material. A switch having the deformable contact element made as a strip material may e.g. be useful for applications where there is limited space, as such a switch can be made narrow in the width direction.

The deformable contact element may be deformed from its first to its second state by an actuator. Such an actuator may e.g. be an actuate-able key mounted on the push button switch. Alternatively the switch may be adapted to be arranged so that the deformable contact element is to be deformed by an actuator not being part of the switch. In both such embodiments, the deformable contact element may be adapted to be activated by having a force asserted thereon from any appropriate angle, such as from above or sideways with respect to the orientation shown in the figures.

In some alternative embodiments, the deformable contact element may be deformed from its first to its second state by compressed air. By using compressed air, or air pressure in general, to deform the contact element, the switch could e.g. be used as an overload sensor in tanks containing non-flammable gasses.

In embodiments of the invention where the first and second surfaces of the deformable contact element are of double curvature, the at least one first terminal point may be formed as an annular region along the whole edge of the deformable contact element. The purpose of such embodiments could e.g. be to obtain lower contact resistance or to allow higher currents to be used.

The first terminal points may alternatively be formed as separate terminal points arranged so that they are connected to the deformable contact element at corresponding separate points thereof. For a contact element with first and second surfaces of double curvature, such first terminal points may be evenly distributed along the edge, whereas for a contact element with first and second surfaces being linear in one direction, such as being made from a strip material, the first terminal points will typically be arranged along the straight and non-moving edges of the deformable contact element only.

The at least one second terminal point may be disposed on a surface at least partly made of electrically conducting material comprising an aperture through which the deformable contact element can be actuated to change from the first state to the second state. Such a surface may e.g. be part of an upper part or a housing of the switch. The electrically conducting surface is not necessarily plane but may e.g. be dome shaped. The shape of the aperture should match the shape of the deformable contact element at all points where electrical contact is to be established, but it may not be necessary to have electrical contact along the whole edge of the aperture. The shape of the aperture may e.g. be such that there is electrical contact between the deformable contact element and the surface along the whole edge of the aperture when the deformable contact element is in the first state, or the electrical contact may be along only part of the aperture. A part of the deformable contact element may extend through the aperture. Alternatively the deformable contact element may e.g. have a plane central portion or curve in the opposite direction of the curving of the remainder of the deformable contact element. This may be advantageous in order to keep the height of the switch to a minimum.

In some embodiments of the invention there are at least two first terminal points. In such embodiments, the deformable contact element may comprise an electrically isolating region disposed so that at least one first terminal point is electrically isolated from at least one other first terminal point. Alternatively or in combination therewith, such an electrically isolating region may also be disposed so that at least one second terminal point is electrically isolated from at least one other second terminal point. A deformable contact element having an isolating region may e.g. be made from an electrically isolating material, such as silicone or PE, which is partly covered by an electrically conducting material, such as a nickel or copper.

BRIEF DESCRIPTION OF THE FIGURES

The push button switch according to the invention will now be described in more detail with regard to the accompanying figures. The figures show one way of implementing the present invention and is not to be construed as being limiting to other possible embodiments falling within the scope of the attached claim set.

FIG. 3 shows schematically the deformable contact element in its second state.

FIG. 4 shows schematically how the deformable contact element can be activated from different directions in different embodiments of the invention. In FIG. 4.*a* it is activated from above, and in FIG. 4.*b* it is activated sideways.

FIG. 8 shows schematically a cross sectional view of an embodiment where a central region of the deformable contact element is flat and does not extend through an aperture in a surface comprising the second terminal points.

FIG. 9 shows schematically an embodiment of the invention wherein the deformable contact element comprises an electrically isolating region at the first surface or through the thickness. FIG. 9.*a* is a top view and FIG. 9.*b* is a side view.

FIG. 10 shows schematically cross sectional views of different designs of the deformable contact element having electrically conducting and electrically isolating regions.

FIG. 11 shows schematically a top or a bottom view of a design of the deformable contact element having electrically conducting and electrically isolating regions.

DETAILED DESCRIPTION OF AN EMBODIMENT

Figure 1:
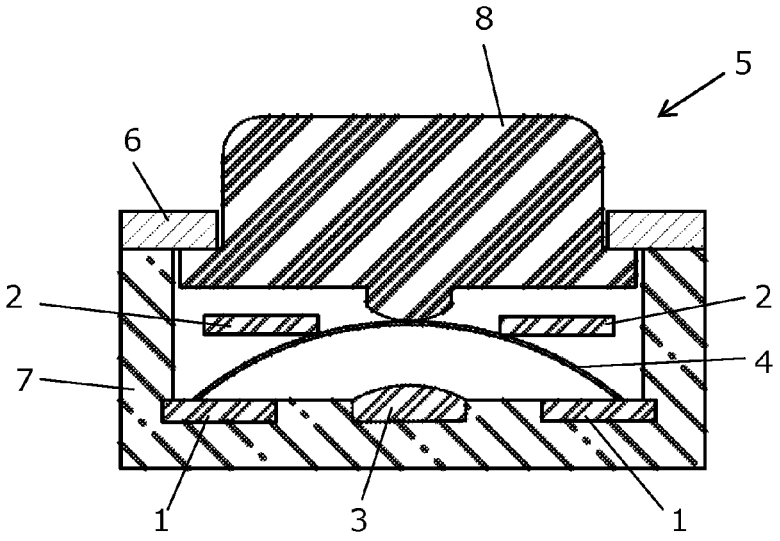
FIG. 1 shows a cross sectional view of an example of a push button switch according to the present invention.

A push button switch 5 according to the present invention may e.g. have a design as the one shown in cross sectional view in FIG. 1. It comprises an upper part 6, a main body 7 and an actuator 8 in the form of an actuateable key. It further comprises a deformable contact element 4 and a number of fixed terminal points 1,2,3 as will be described in details in the following.

Figure 2:
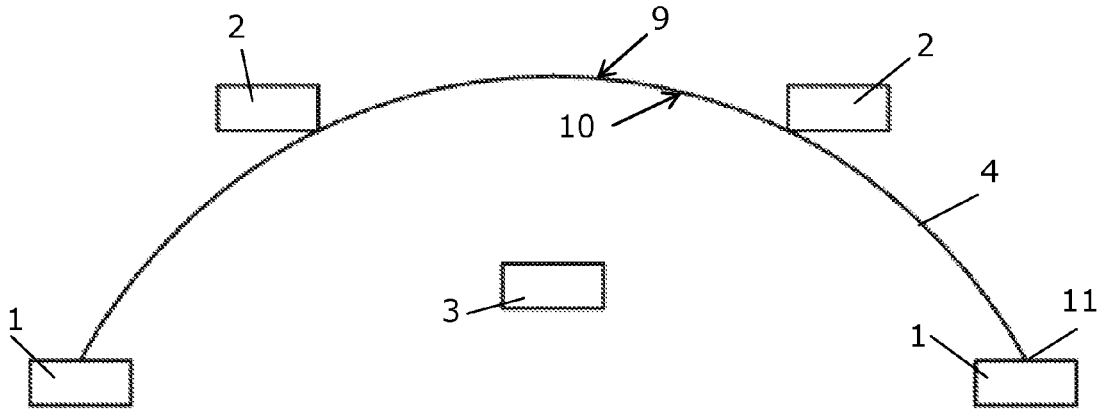
FIG. 2 shows schematically the mutual arrangement of the terminal points and the deformable contact element in its first state.

As shown in FIG. 2, the deformable contact element 4 has a first convex surface 9 and an opposite second concave surface 10. It comprises first terminal points 1 which are disposed adjacent to an edge 11 of and electrically connected to the deformable contact element 4. In the unactivated state of the deformable contact element 4 as shown in the figure, second terminal points 2 are disposed so that they are electrically connected to the first surface 9 of the deformable contact element 4 at a distance from the edge 11 of the deformable contact element 4. A third terminal point 3 is disposed so that it is electrically connectable to the second surface 10 of the deformable contact element 4. The third terminal point 3 is disposed in the volume defined by the concave surface 10 of the deformable contact element 4 and at a distance from the edge 11 of the deformable contact element 4. In the illustrated embodiment, there is only one third terminal point, but switches having a plurality of third terminal points are also covered by the scope of the present invention. The at least one third terminal point 3 is not necessarily arranged symmetrically with respect to the deformable contact element 4.

The deformable contact element 4 has a first and a second state as shown schematically in FIGS. 2 and 3, respectively. In the first state, also referred to as the "normal" state, wherein the deformable contact element 4 is unactivated and thereby undeformed, the deformable contact element 4 connects first terminal points 1 with second terminal points 2, whereas there is neither contact between the third terminal point 3 and the the first terminal points 1 nor between the third terminal point 3 and second terminal points 2. A push button switch 5 having such a configuration is therefore also referred to as being normally closed and normally open. With the designation of the terminal points as used in the present description, the switch 5 shown in FIGS. 2 and 3 is normally closed with respect to the first and second terminal points 1,2 and normally open with respect to the third terminal point 3 and the first and second terminal points 1,2.

In the second state which is shown in FIG. 3, the deformable contact element 4 is activated and thereby deformed and connects first terminal points 1 with the third terminal point 3, whereas there is neither contact between the second terminal points 2 and the first terminal points 1 nor between the second terminal points and third terminal point 3.

FIGS. 2 and 3 are schematical cross sectional views, and they illustrate both embodiments wherein the first and second surfaces 9,10 of the deformable contact element 4 have double curvature, such as being dome shaped, and embodiments wherein the first and second surfaces 9,10 of the deformable contact element 4 is linear in one direction and curved in the other directions, such as being made from a strip of material. In the latter case, the deformable contact element 4 is linear perpendicular to the plane of the paper.

In the push button switch 5 shown in FIG. 1, the deformable contact element 4 is deformed from its first to its second state by an actuator 8 in the form of an actuate-able key being a part of the push button switch 5. Such a key may e.g. be adapted to be manually activated. The actuator 8 may also be part of an automated or semi-automated system. It can e.g. be used to check correct positions in pneumatically driven systems, or it can be used as a circuit breaker if e.g. pistons move out of a desired working range. The actuator 8 may in principle be arranged to move in any direction which will provide a deformation of the deformable contact element 4. In practice it will typically be arranged to excert a pressure on the deformable contact element 4 either from above or sideways with reference to the orientation of the embodiments shown schematically in FIGS. 4.*a* and 4.*b*, respectively. When in use, the push button switch 5 may of course be arranged in any desired orientation, such as upside down or turned 90° compared to what is shown in the figures.

Figure 5:
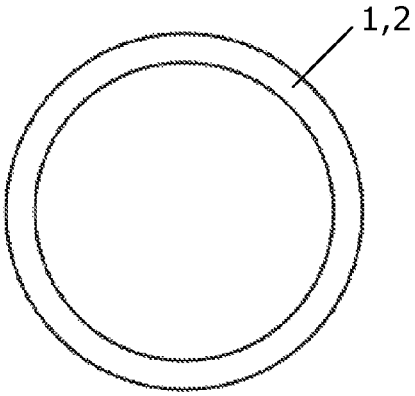
FIG. 5 shows schematically an annularly shaped first or second terminal point.
Figure 6:
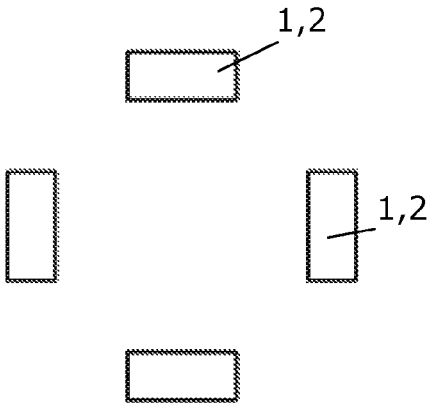
FIG. 6 shows schematically an example of how first and second terminal points can be arranged separated.

FIG. 5 shows schematically a top view of a possible layout of an annular first terminal point 1. Such a shape will typically be used in combination with a dome-shaped deformable contact element 4 arranged so that the annular region of the first terminal point 1 is situated along the whole edge 11 of the deformable contact element 4. For a double-curved deformable element 4 having different curvatures in perpendicular directions, a corresponding coherent first terminal point 1 will be formed as an elliptical region. For both these shapes of the deformable contact element 4, the first terminal points 1 may alternatively be formed as separate first terminal points 1 as shown schematically in FIG. 6. FIG. 6 shows four terminal points 1, but any desired number will be possible within the scope of the present invention.

In the same manner as described for the at least one first terminal point 1, the at least one second terminal point 2 may also be shaped as an annular surface or as a number of separate second terminal points 2 arranged so that they are electrically connected to the deformable contact element 4, when it is in the first state.

Figure 7:
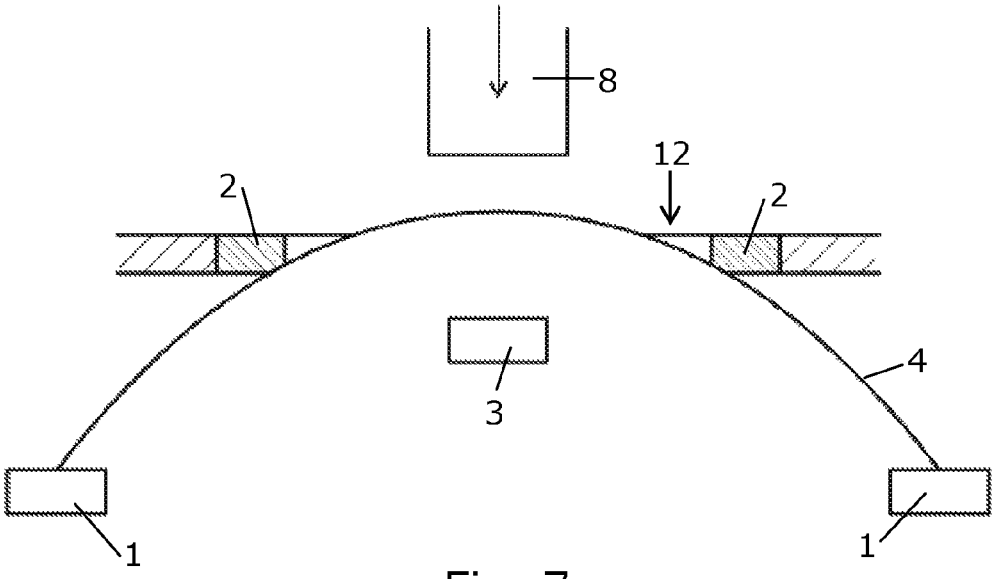
FIG. 7 shows schematically a cross sectional view of an embodiment where the deformable contact element extends through an aperture in a surface comprising the second terminal points.

FIG. 7 shows an embodiment wherein the deformable contact element 4 extends through an aperture 12 in a surface at least partly of electrically conducting material. The deformable contact element 4 can be actuated to change from the first state to the second state by being pressed through the aperture by use of an actuator 8. FIG. 8 shows an alternative embodiment wherein the deformable contact element 4 is flat at the apex so that it does not extend through the aperture 12. Such a design may e.g. be used to minimize the height of the switch 5.

If the deformable contact element 4 is made entirely from an electrically conductive material, all the first terminal points 1 will typically be connected to each other at any time. Correspondingly, all the second terminal points 2 will typically be connected to each other when the deformable contact element 4 is in its first state and disconnected when the deformable contact element 4 is in its second state.

FIG. 9 shows an embodiment wherein the deformable contact element 4 comprises an electrically isolating region 13 disposed across the first surface 9 and two second terminal points 2 being electrically isolated from each other by the isolating region 13 also in the first state. FIG. 9.*a* is a top view and FIG. 9.*b* is a side view. A corresponding electrically isolating region 13 may be disponsed on the second surface 10 so that first terminal points 1 are also electrically isolated when arranged on opposite sides of the electrically isolating region 13. This may e.g. be obtained by having electrically isolating material extending through the thickness of the deformable contact element 4. Such a configuration can e.g. be obtained by coating one or more predetermined regions of a polymer material with an electrically conductive layer, such as nickel or copper. By doping/coating predetermined regions of a non conducting deformable element, one can reduce the number of moveable parts in the switch.

FIG. 10 shows schematically cross sectional views of different designs of the deformable contact element 4 having electrically conducting and electrically isolating regions. In FIGS. 10 and 11, electrically conducting material is shown with solid lines, and electrically isolating material is shown with dotted lines. The actual extensions of the regions may vary from those shown in the figures as long as the overall principles shown in the figures are fulfilled.

FIG. 10.*a* shows the deformable contact element as a one layered structure having a central electrically isolating region 13 in the form of a band extending through the thickness of the contact element 4 and across the contact element 4 in the plane perpendicular to the paper. The rest of the deformable contact element 4 is made from electrically conducting material forming two regions 14 being electrically isolated from each other. Such a design may e.g. be obtained by injection moulding comprising injecting two polymer materials, the one containing electrically conductive particles.

FIG. 10.*b* shows the deformable contact element 4 designed from an electrically isolating element having electrically condictive material arranged on both sides thereof over two regions 14. Hereby an electrically isolating central region 13 is formed which extends through the thickness of the deformable element 4. In order to establish electrical contact between the two electrically condictive layers at each region 14, the electrically isolating element is perforated at the part being arranged between the electrically conductive material.

FIG. 10.*c* shows a deformable element 4 made from an electrically conductive upper layer, such as a metal dome. An electrically isolating film is arranged just below the metal dome, e.g. in the form of a polymer film. Further below, two regions 14 are covered by electrically conductive material, e.g. in the form of a layer or film of metal material. Hereby a central electrically isolating region 13 is obtained on the lower second surface 10 of the deformable contact element 4 only. In a corresponding way, an electrically isolating region 13 could be established on an upper first surface 9.

FIG. 11 shows schematically a top or a bottom view of another design of the deformable contact element having electrically conducting and electrically isolating regions. Here the main part of the deformable contact element is made from electrically conductive material. Electrically isolating material is arranged at limited regions 13 thereof, and part of these electrically isolating regions 13 are again covered by electrically conductive material 14.

A push button switch according to the present invention may in principle have any size, but typical sizes are widths in the order of 10-20 mm. The main body 7 and the upper part 6 will typically be made by injection moulding, and the push button switches are typically assembled in fully- or semi-automated processes. They may be made as separate components, or they may be incorporated in other products, such as medical equipment. In the latter case, the upper part 6 as shown in FIG. 1 will typically be omitted.

Although the present invention has been described in connection with the specified embodiments, it should not be construed as being in any way limited to the presented examples. The scope of the present invention is set out by the accompanying claim set. In the context of the claims, the terms "comprising" or "comprises" do not exclude other possible elements or steps. Also, the mentioning of references such as "a" or "an" etc. should not be construed as excluding a plurality. The use of reference signs in the claims with respect to elements indicated in the figures shall also not be construed as limiting the scope of the invention. Furthermore, individual features mentioned in different claims, may possibly be advantageously combined, and the mentioning of these features in different claims does not exclude that a combination of features is not possible and advantageous.

The invention claimed is:

1. A push button switch, comprising a deformable contact element having a first convex surface and an opposite second concave surface, wherein:

at least one first terminal point is disposed adjacent to an edge of and electrically connected to the deformable contact element, at least one second terminal point is disposed so that it is electrically connectable to the first surface of the deformable contact element at a distance from the edge of the deformable contact element, and at least one third terminal point is disposed so that it is electrically connectable to the second surface of the deformable contact element and is disposed in the volume defined by the second concave surface at a distance from the edge of the deformable contact element, and wherein, when in use, the deformable contact element has:

a first state in which the deformable contact element is unactivated and connects the at least one first terminal point with the at least one second terminal point, whereas there is neither contact between the at least one third terminal point and the at least one first terminal point nor between the at least one third terminal point and the at least one second terminal point, and a second state in which the deformable contact element is activated and connects the at least one first terminal point with the at least one third terminal point, whereas there is neither contact between the at least one second terminal point and the at least one first terminal point nor between the at least one second terminal point and the at least one third terminal point.

2. The push button switch according to claim 1, wherein the first and the second surfaces of the deformable contact element have double curvature.

3. The push button switch according to claim 1, wherein the first and the second surfaces of the deformable contact element are linear in one direction and curved in the other directions.

4. The push button switch according to claim 1, wherein the deformable contact element is deformed from its first to its second state by an actuator.

5. The push button switch according to claim 4, wherein the actuator is an actuate-able key mounted on the push button switch.

6. The push button switch according to claim 1, wherein the deformable contact element is deformed from its first to its second state by compressed air.

7. The push button switch according to claim 2, wherein the at least one first terminal point is formed as an annular region along the whole edge of the deformable contact element.

8. The push button switch according to claim 1, comprising two or more first terminal points which are formed as separate terminal points.

9. The push button switch according to claim 1, wherein the at least one second terminal point is disposed on a surface at least partly made of electrically conducting material comprising an aperture through which the deformable contact element can be actuated to change from the first state to the second state.

10. The push button switch according to claim 1, wherein there are at least two first terminal points, and wherein the deformable contact element comprises an electrically isolating region disposed so that at least one first terminal point is electrically isolated from at least one other first terminal point.

11. The push button switch according to claim 1, wherein there are at least two second terminal points, and wherein the deformable contact element comprises an electrically isolating region disposed so that at least one second terminal point is electrically isolated from at least one other second terminal point.

* * * * *